US006540335B2

(12) United States Patent
Touge et al.

(10) Patent No.: US 6,540,335 B2
(45) **Date of Patent: *Apr. 1, 2003**

(54) INK JET PRINT HEAD AND INK JET PRINTING DEVICE MOUNTING THIS HEAD

(75) Inventors: Yoshiyuki Touge, Sagamihara; Shuichi Murakami, Kawasaki; Takashi Inoue, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/203,394

(22) Filed: Dec. 2, 1998

(65) Prior Publication Data

US 2002/0057315 A1 May 16, 2002

(30) Foreign Application Priority Data

Dec. 5, 1997 (JP) ..... 9-336052
Nov. 27, 1998 (JP) ..... 10-337211

(51) Int. Cl.[7] ..... B41J 2/05; B41J 2/17
(52) U.S. Cl. ..... 347/65; 347/67; 347/94
(58) Field of Search ..... 347/63, 65, 67, 347/92, 93, 94

(56) References Cited

U.S. PATENT DOCUMENTS

| | | | | |
|---|---|---|---|---|
| 4,368,476 A | * | 1/1983 | Uehara et al. | 347/65 |
| 4,897,674 A | * | 1/1990 | Hirasawa | 347/65 |
| 5,847,730 A | * | 12/1998 | Miyashita et al. | 347/45 |
| 5,912,685 A | * | 6/1999 | Raman | 347/65 |
| 6,045,214 A | * | 4/2000 | Murthy et al. | 347/47 |
| 6,158,843 A | * | 12/2000 | Murthy et al. | 347/47 |

FOREIGN PATENT DOCUMENTS

| | | | |
|---|---|---|---|
| DE | 196 10 829 | 1/1997 | B41J/2/14 |
| EP | 0 500 068 | 8/1992 | B41J/2/175 |
| EP | 0 609 012 | 8/1994 | B41J/2/16 |
| EP | 0 627 318 | 12/1994 | B41J/2/175 |
| EP | 0 694 398 | 1/1996 | B41J/2/14 |
| EP | 0 771 664 | 5/1997 | B41J/2/175 |
| EP | 0 779 337 | 6/1997 | C08L/63/00 |
| JP | 2-212153 | 8/1990 | B41J/2/175 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet print head has plural electrothermal converting elements for generating energy used to discharge an ink droplet, plural ink discharging ports arranged above the electrothermal converting elements and discharging the ink droplet, plural ink flowing paths respectively communicated with the plural ink discharge ports and internally including the electrothermal converting elements, a substrate for arranging the plural electrothermal converting elements in a columnar shape and having an ink supplying port constructed by a through port which is connected with the ink flowing paths and extends along an arranging direction of the electrothermal converting elements, and a discharging port plate having the ink discharge ports. The ink flowing paths are formed between the substrate and the discharging port plate by junctioning the discharging port plate onto the substrate. The ink jet print head further has a fluid resisting device of the ink flowing paths in which a side of the ink supplying port is opened in the vicinity of a communication portion of the ink flowing paths in an ink supplying port projecting are of the discharging port plate.

20 Claims, 8 Drawing Sheets

INK JET PRINT HEAD AND INK JET PRINTING DEVICE MOUNTING THIS HEAD

BACKGROUND OF THE INVENTION

1. Field of the Invention

The present invention relates to an ink jet print head used in an ink jet recording system for performing a recording operation to a recording medium by flying a small ink droplet, and an ink jet printing device using this head.

2. Related Background Art

There are a method utilizing an electrothermal converting element (heater) as a discharging energy generating element used to discharge an ink droplet and a method utilizing a piezoelectric element as this discharging energy generating element in an ink discharging method of an ink jet recording system widely generally used at present. In each of these methods, discharging of the ink droplet can be controlled by an electric signal. For example, in the principle of the ink droplet discharging method using the electrothermal converting element, ink in the vicinity of the electrothermal converting element is instantaneously boiled by giving the electric signal to the electrothermal converting element, and the ink droplet is discharged at high speed by growing a sudden bubble caused by a change in phase of the ink at this time. In contrast to this, in the principle of the discharging method of the ink droplet using the piezoelectric element, the piezoelectric element is displaced by giving the electric signal to the piezoelectric element and the ink droplet is discharged by a pressure at a time of this displacement. Here, with respect to merits in the former method, it is not necessary to arrange a large space for the discharging energy generating element, and the structure of an ink jet print head is simple and ink flow paths are easily integrated, etc. However, in this method, the air dissolved within the ink is eluted by heat generated from the electrothermal converting element and a residual bubble is caused within the ink jet print head. When this residual bubble is left as it is, the residual bubble has bad influences on discharging characteristics of the ink droplet and an image.

The influences of the residual bubble within the ink jet print head caused by the air dissolved within this ink on the ink droplet discharging characteristics and the image will next be explained in detail. The air is normally dissolved into the ink within the ink jet print head in a saturation state. When the electrothermal converting element is operated in this state, there is a case in which the air dissolved into the ink suddenly appears within the ink as a dissolved bubble having a diameter equal to or smaller than about 1 $\mu$m in repetitions of adiabatic contraction of foaming and a sudden bubble by a change in phase of the ink. It is also known that such a bubble is again dissolved into the ink for a time determined from a bubble diameter, surface tension of the ink, a saturated vapor pressure of the air, etc. For example, if the bubble diameter is equal to smaller than 1 $\mu$m, a time required for the dissolution is an order equal to smaller than 1 $\mu$s. However, when plural electrothermal converting elements are continuously operated at high frequency, a plurality of such bubbles appear within the ink and are mutually collected and grown before these bubbles are again dissolved. It is known that a time required for the redissolution is greatly increased when the bubble diameter is increased. As a result, plural residual bubbles from several tens of $\mu$m to several hundred $\mu$m in diameter are stored within the ink jet print head. In such a case, no such residual bubbles are almost again dissolved into the ink so that these residual bubbles have a bad influence on discharging characteristics of the ink droplet. Namely, if an ink flowing path is blocked by the residual bubbles, the ink flowing path is not filled with sufficient ink so that a discharging defect is caused. Further, when a great residual bubble (about several hundred $\mu$m in diameter) is caused within the ink jet print head and is accidentally communicated with the external air, the external air enters the ink flowing path so that a meniscus is broken. Therefore, the ink within the ink jet print head is sucked-up to an ink tank by a negative pressure for sucking-up the ink of the ink tank so that no ink is discharged from the ink flowing path in a certain case. As a most effective solving means for avoiding such a bad influence of the residual bubbles, there is a method for externally discharging the residual bubbles together with the ink from an ink discharge port by suction, pressurization, etc. before the residual bubbles are grown to such an extent that the residual bubbles have the above-described bad influence. This method is a method for performing so-called suction (pressurization) restoring processing. However, in this case, a consuming amount of the ink is greatly increased and throughput is naturally reduced if this method is executed during a printing operation. There is another method in which the air dissolved into the ink is discharged from the ink (deairing) by a certain method, and such ink is used in the ink jet print head. A most effective operating time of this solving method is about several tens of minutes from the deairing of the ink, and a device for deairing the ink is relatively large-sized so that usage of this technique is limited to a printing system, etc. on a large scale.

Therefore, in consideration of such a problem of the residual bubbles, in an ink jet print head described in Japanese Patent Application Laid-Open No. 10-146976, as shown in FIGS. 7A and 7B, plural projections 7 are arranged at a certain interval just above an ink supplying port 8 on the inner surface of a discharging port plate 5 so that growing of a bubble attached to the inner surface of the discharging port plate 5 is restrained. Further, a common ink flowing path portion common to electrothermal converting elements 1 as adjacent discharging energy generating elements 1 is arranged to stably supply ink so that supplying interruption of the ink caused by flowing a bubble 11 attached to an end tip of a projection 7 and grown to about $\phi$150 $\mu$m in diameter into the ink flowing path is restrained.

However, in the above conventional examples, the bubble itself exists near the ink supplying port as it is. Therefore, when the ink is printed to an elongated recording medium as in banner printing, textile printing, etc. there is a case in which restoring processing must be intermediately performed. However, when a restoring operation is performed during printing of one sheet, a color tone is changed in this restoring portion and this change has a bad influence on printing quality. Therefore, it is not desirable to perform the restoring operation during the printing. Such a situation can be avoided by performing the restoring operation at any time every time the recording medium is changed. However, when the restoring operation is often performed, the throughput of a printed matter is reduced. Further, a problem exists in that a useless ink amount is increased.

SUMMARY OF THE INVENTION

In consideration of the above problems, an object of the present invention is to provide an ink jet print head for relaxing the bad influence of a bubble left within the ink jet print head on ink liquid discharge, and discharging a stable ink droplet with high reliability.

Another object of the present invention is to provide an ink jet printing device having an excellent throughput and reducing an ink consuming amount by controlling a residual bubble and further reducing the number of restoring times.

To achieve the above objects, in the present invention, an ink flow is made near a through port of a substrate of an ink jet print head by a hydrodynamic action of ink so that a bubble attached to a wall face of a common liquid chamber is easily separated therefrom or the bubble is not easily attached to this wall face. In the construction of the present invention, an ink jet print head comprises plural electrothermal converting elements for generating energy used to discharge an ink droplet; plural ink discharge ports arranged above the electrothermal converting elements and discharging the ink droplet; plural ink flowing paths respectively communicated with the plural ink discharge ports and internally including the electrothermal converting elements; a substrate for arranging the plural electrothermal converting elements in a columnar shape and having an ink supplying port constructed by a through port which is connected with the ink flowing paths and extends along an arranging direction of the electrothermal converting elements; and a discharging port plate having the ink discharge ports; the ink jet print head being constructed such that the ink flowing paths are formed between the substrate and the discharging port plate by junctioning the discharging port plate onto the substrate; and the ink jet print head further comprising fluid resisting means of the ink flowing paths in which a side of the ink supplying port is opened in the vicinity of a communication portion of the ink flowing paths in an ink supplying port projecting area of the discharging port plate.

In accordance with the ink jet print head having the above construction of the present invention, a speed component in a direction of the common liquid chamber can be given to the ink flow parallel to the discharging port plate near the ink supplying port at an ink discharging time. Therefore, the bad influence of a bubble left within the ink jet print head on ink liquid discharge is relaxed. Accordingly, it is possible to provide an ink jet print head in which an ink droplet is stably discharged with high reliability. It is also possible to provide an ink jet printing device in which throughput is excellent and an ink consuming amount is reduced by further reducing the number of restoring times.

DETAILED DESCRIPTION OF THE PREFERRED EMBODIMENTS

The embodiments of the present invention will next be explained with reference to the drawings.

[First Embodiment]

Contents of the present invention will next be explained in detail with reference to the drawings.

Figure 1A:
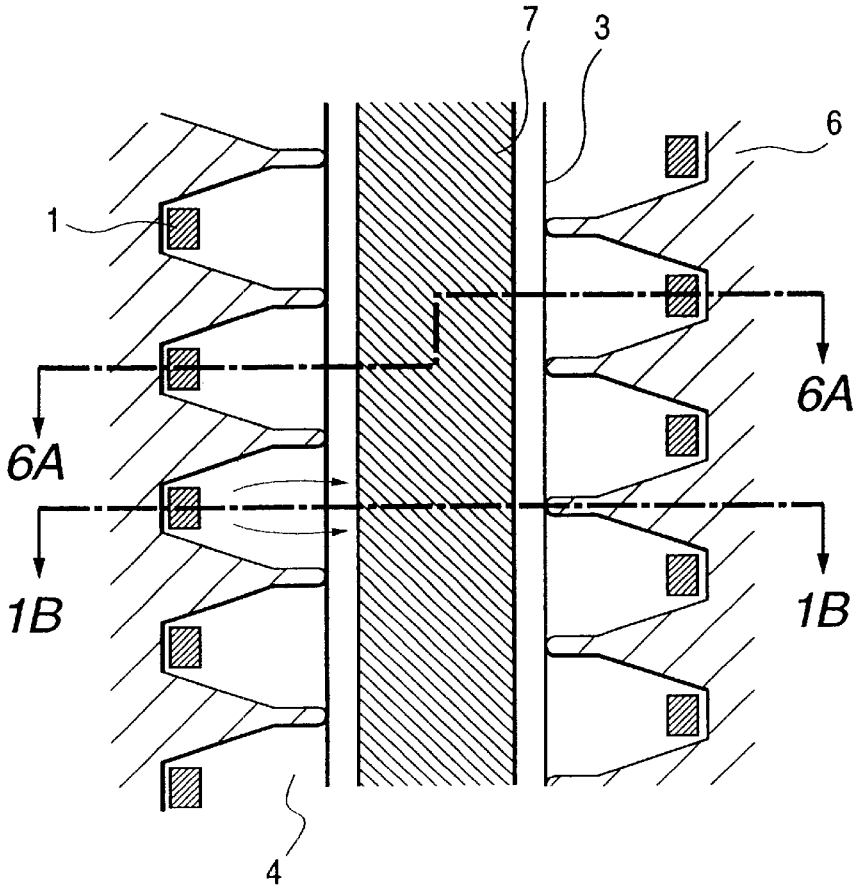
FIG. 1A is a perspective plan view of an ink jet print head in accordance with a first embodiment of the present invention.

FIG. 1A is a typical view of an ink jet print head in accordance with a first embodiment of the present invention. A discharging port is directed downward in FIG. 1B.

Figure 1B:
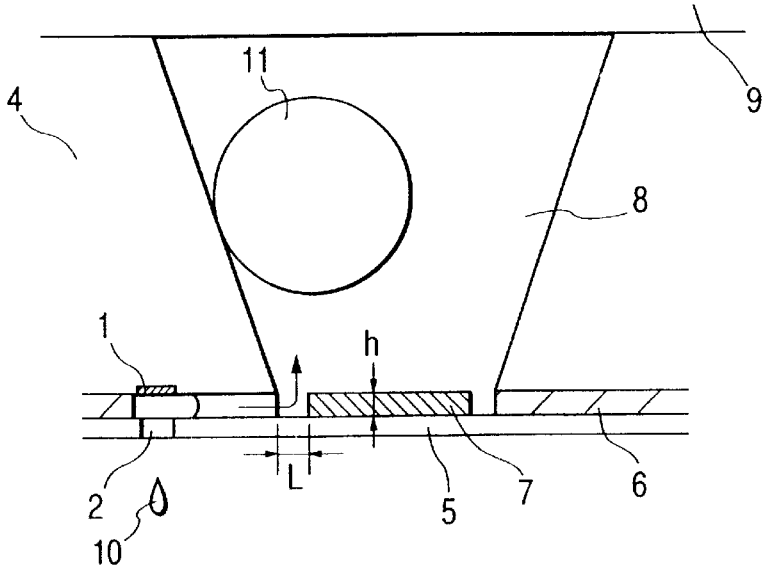
FIG. 1B is a cross-sectional view taken along line 1B—1B of FIG. 1A.

In FIGS. 1A and 1B, a substrate 4 has an ink supplying port end 3 constructed by a through port formed in a long groove shape. Electrothermal converting elements 1 as discharging energy generating elements are arranged in a zigzag shape every one column on both sides of the ink supplying port end 3 in its longitudinal direction. A covering resin layer 6 as an ink flowing path wall for forming an ink flowing path is arranged on this substrate 4. A discharging port plate 5 having a discharging port 2 is arranged on this covering resin layer 6. Further, a long projection 7 in an arranging direction of the electrothermal converting elements is arranged just above the ink supplying port end 3 on an inner surface of the discharging port plate 5. Here, an edge of the ink supplying port end 3 is shown by a straight line in FIGS. 1A and 1B, but there is also a case in which this edge is actually more or less curved (by about several $\mu$m) from the problem of a manufacturing method. Since the projection 7 has a tapering shape, no wall of the projection 7 is strictly perpendicular to the discharging port plate 5 and the projection 7 has the same height h as the covering resin layer 6. It is preferable that the projection 7 is longer. However, the length of the projection 7 may be also set to be short. Further, the covering resin layer 6 and the projection 7 are shown as separate members, but can be simultaneously formed as the same member by forming this covering resin layer 6 on the substrate 4 by a technique such as spincoat, etc. The substrate 4 is fixed by a supporting member 9 and an ink supplying port 8 is arranged between the ink supplying port end 3 of the substrate 4 and the supporting member 9. An unillustrated round hole flowing path for supplying ink to the ink supplying port 8 is formed in the supporting member 9.

The movement of a residual bubble in each of the ink jet print head of the present invention and a conventional ink jet print head will next be explained.

Figure 7A:
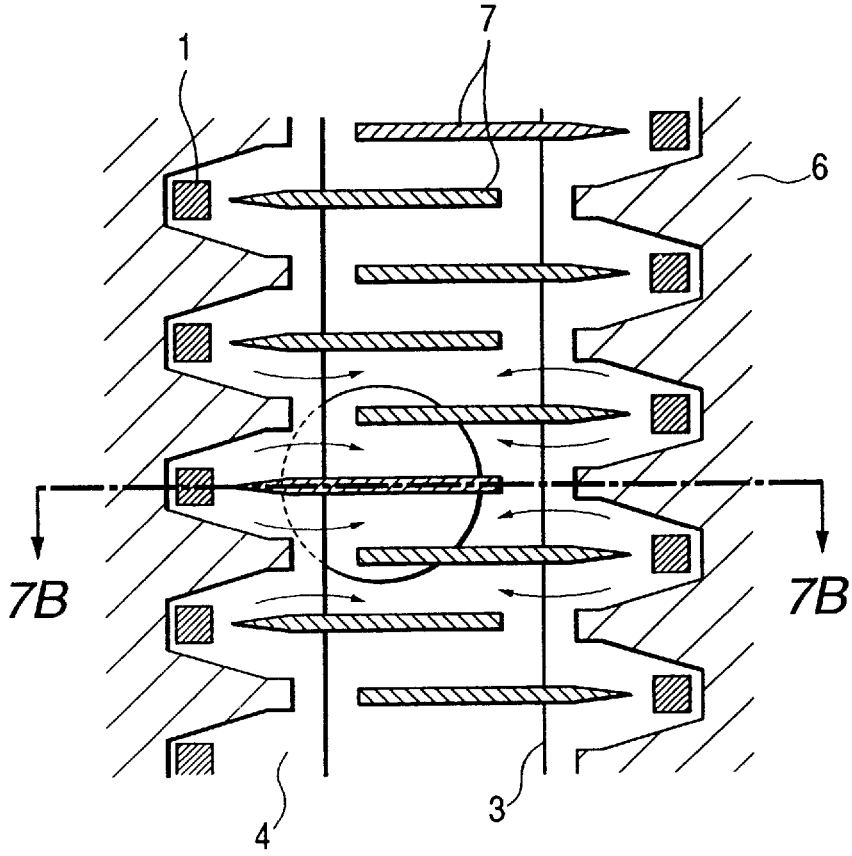
FIG. 7A PRIOR ART
FIG. 7A is a perspective plan view showing the construction of a conventional ink jet print head.
Figure 7B:
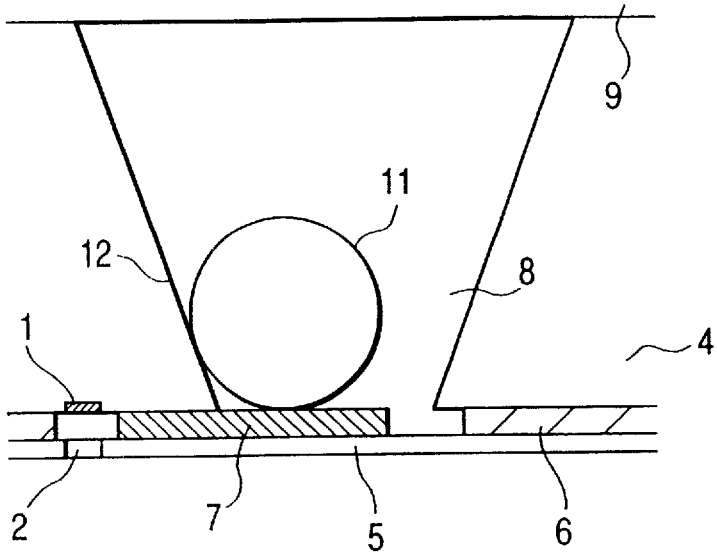
FIG. 7B PRIOR ART
FIG. 7B is a cross-sectional view taken along line 7B—7B of FIG. 7A.

First, in the conventional construction (FIGS. 7A and 7B), when an electrothermal converting element 1 is heated by applying an electric signal to this element and a bubble is generated, an ink droplet 10 is discharged from the discharging port 2 and a high speed ink flow is simultaneously generated from the ink flowing path to the ink supplying port end 3. A fine residual bubble is included in this ink flow and is conveyed to the ink supplying port. When this ink flow reaches a portion of the ink supplying port end 3, an eddy is caused in a corner portion of the ink supplying port and this eddy portion tends to be stagnated. When the bubble stays in this stagnant portion, this bubble is attached to an ink supplying port wall face 12 so that this bubble is not easily removed from the ink supply port wall face 12. Then, this bubble is grown every time the fine residual bubble is attached to this bubble. A bubble having several hundred pm in diameter is finally formed. When a plurality of such bubbles having several hundred $\mu$m in diameter exist within the ink supplying port 8, the bubbles block the ink supplying path in a wide range so that the effect of a common ink flowing path portion is greatly reduced and the ink supply becomes insufficient.

In contrast to this, in the construction of the present invention, a high speed ink flow directed from the ink flowing path to the ink supplying port end 3 hits against a wall face of the projection 7 so that the direction of the high speed ink flow is changed to a downward direction in FIGS. 1A and 1B (an arrow mark in these figures). Thus, a speed component in a common liquid chamber direction is given to the ink flow. This ink flow includes small bubbles such as a residual bubble generated by cavitation caused by the high speed ink flow and a bubble, etc. discharged from the discharging port at an ink discharging time. These small bubbles are collected and grown within the ink supplying port 8 so that a bubble 11 is formed. Upward force in FIGS. 1A and 1B is applied to the bubble near the supplying port by the high speed ink flow near the ink supplying port. As a result, the bubble 11 pushed and flowed by the high speed ink flow is attached to a wall portion separated from the supplying port and is grown. Accordingly, an influence of bubbles on the ink supply is small even when many big bubbles exist. Therefore, no ink supplying defect is caused even when the size of a bubble is increased in comparison with the conventional case. When the distance L between a longitudinal wall of the projection 7 and the edge of the ink supplying port end 3 is excessively increased, the speed of the ink flow is reduced and hydrodynamic force applied to the bubble is reduced so that the above effect is weakened. When the distance L is extremely smaller than the height h, this small portion becomes a resistance so that this resistance has a bad influence on refill characteristics. Accordingly, it is not preferable that the distance L is extremely smaller than the height h.

In FIGS. 1A and 1B and subsequent figures, an electric wiring for operating the electrothermal converting element 1, etc. are not illustrated. In this embodiment, a silicon substrate (wafer) is used as a material of the substrate 4, but the present invention is not particularly limited to this case. Glass, ceramics, plastic, or a metal, etc. may be also used as the substrate if the electrothermal converting element 1 as an ink discharging generating element is constructed by this substrate and this substrate constitutes a supporting body of the discharging port plate 5 as a material layer forming the ink discharge port 2, and this substrate can function as one portion of an ink flowing passage constructional member.

Figure 6A:
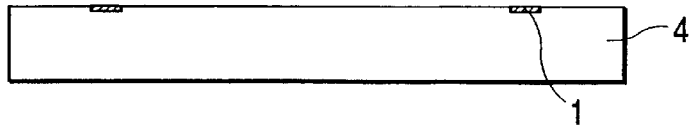
FIGS. 6A, 6B, 6C, 6D, 6E, 6F and 6G are explanatory process views showing one example of a manufacturing method of the ink jet print head of the present invention.
Figure 6B:
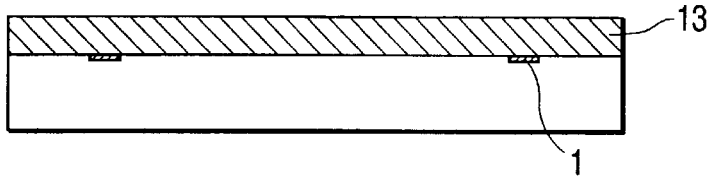
Figure 6C:
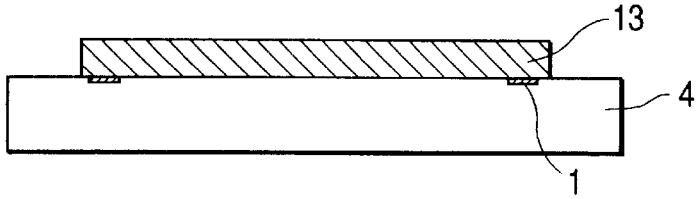
Figure 6D:
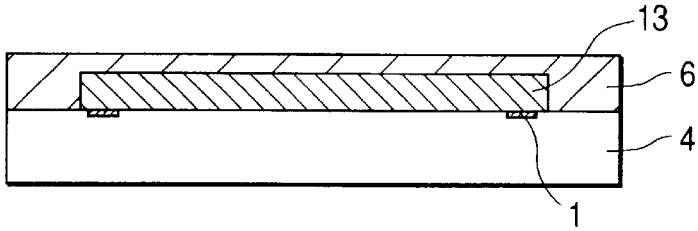

FIGS. 6A to 6G (cross-sectional views taken along line 6A—6A of FIG. 1A) show a manufacturing method of the ink jet print head in the present invention. In this embodiment, a desirable number of electrothermal converting elements 1 are first arranged on the substrate 4 shown in FIGS. 1A and 1B. Next, as shown in FIG. 6B, a soluble resin layer 13 is formed on the substrate 4 including the electrothermal converting elements 1. As shown in FIG. 6C, an ink flow path pattern is formed in this resin layer 13. At this time, a pattern for providing a rib structure is formed on an upper face of the resin layer 13 corresponding to a forming portion of the ink supplying port 8 (see FIG. 6E). Further, a covering resin layer 6 is formed on the above soluble resin layer 13 as shown in FIG. 6D. An ink discharge port 2 is formed in the covering resin layer 6 (see FIG. 6E). It is sufficient to form the ink discharge port 2 by a conventional technique. For example, the ink discharge port 2 can be formed by any technique such as etching using $O_2$ plasma, excimer laser boring, exposure using an ultraviolet ray, a deep-UV ray, etc.

Figure 6E:
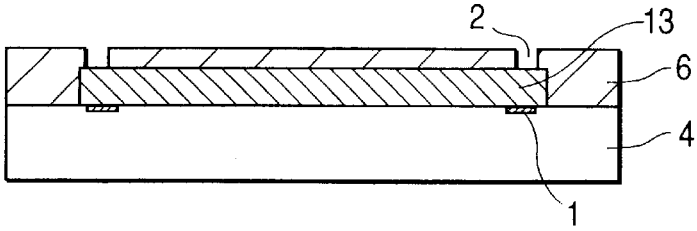
Figure 6F:
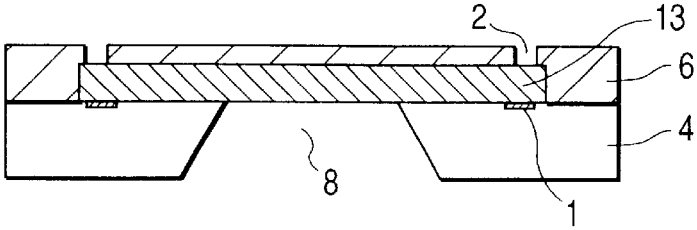
Figure 6G:
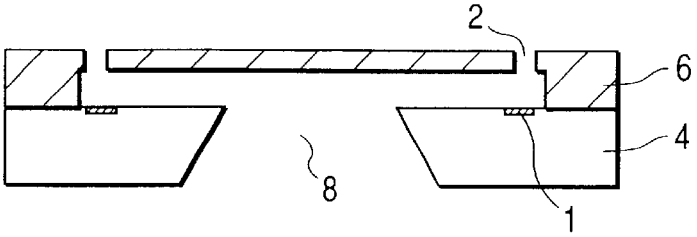

The ink supplying port 8 is next formed in the substrate 4. The ink supplying port 8 is formed by chemically etching the substrate. More concretely, a silicon (Si) substrate is used as the substrate 4, and the ink supplying port 8 is formed by anisotropic etching using a strong alkali solution such as KOH, NaOH, TMAH, etc. (see FIG. 6G). At this time, the ink supplying port can be also formed before an ink flowing path pattern and a pattern for providing the rib structure are formed as shown in FIGS. 6B and 6C and the ink discharge port is formed as shown in FIGS. 6D and 6E. However, the rib structure as shown in the present invention can be achieved by forming a soluble resin layer on a flat face and forming a pattern and further forming a covering resin layer on this pattern as shown above. After the ink flowing path pattern, the pattern providing the rib structure and the ink discharge port are formed, it is considered to use a mechanical means such as a drill, etc. and light energy such as a laser, etc. as a means for forming the ink supplying port. However, there is a possibility of damaging the previously formed ink flowing path pattern, etc. in these techniques. Accordingly, it is difficult to adopt these techniques. Therefore, it is optimal to form the ink supplying port by chemical etching, especially, anisotropic etching of the silicon substrate. Subsequently, as shown in FIG. 6G, the ink flowing path can be formed by eluting the soluble resin layer 13. At this time, the rib structure is formed on the ink supplying port end 3. Finally, the ink jet print head is completed by making an unillustrated electric junction for operating each of the electrothermal converting element 1.

The present invention has excellent effects in the recording head of a bubble jet system among the ink jet print head. The present invention is particularly optimal for a recording head manufactured by a method described in each of Japanese Patent Application Laid-Open Nos. 4-10940, 4-10941 and 4-10942. In each of these publications, a driving signal corresponding to recording information is applied to an electrothermal converting element and thermal energy providing a sudden rise in temperature exceeding nuclear boiling of ink is generated from the electrothermal converting element. Thus, a bubble is formed within the ink and is communicated with the external air and an ink liquid droplet is discharged. In the above method, a small ink liquid droplet (equal to or smaller than 50 pl) can be discharged and the ink liquid in front of a heater is discharged. Therefore, the ink liquid droplet is stabilized in volume and speed without any influence of temperature so that an image having a high quality can be obtained. The present invention is also effective as a recording head of a full line type capable of simultaneously recording an image over the entire width of a sheet of recording paper. Further, the present invention is effective in a color recording head in which the recording head is integrally formed or plural recording heads are combined with each other.

Next, an ink jet print head having the following construction is manufactured as the ink jet print head corresponding to the above first embodiment. Namely, the ink jet print head has an ink supplying port 8 constructed by a through port formed in the shape of a long groove having 155 μm×11 mm in size. A substrate 4 has 128 electrothermal converting elements 1 as discharging energy generating elements on both sides of the ink supplying port 8 in its longitudinal direction. These electrothermal converting elements 1 are arranged in a zigzag shape at a pitch of 300 DPI every one column. A covering resin layer 6 having a height H=12 μm and a discharging port plate 5 having a thickness of 9 μm are formed on the substrate 4. Thus, the ink jet print head in this embodiment is made. The distance L between the ink supplying port end 3 and a wall of the above projection 7 in its longitudinal direction is changed to 12, 16.5 and 27.5 μm so that three kinds of ink jet print heads are made.

First, a solid black printing operation is performed by using these three kinds of ink jet print heads. Thereafter, a collecting situation of bubbles is observed from a front face of the discharging port plate after the full black printing operation. In a conventional example, bubbles exist only near the ink supplying port. However, in each of the three kinds of ink jet print heads in the first embodiment, bubbles exist in a deep portion of a common liquid chamber so that bubble separating effects obtained by the projection can be confirmed.

A continuation time of the solid black is measured at a discharging frequency of 10 kHz, and the ink jet print head in this embodiment and the conventional ink jet print head are compared with each other and are evaluated. Table 1 shows measured and evaluated results.

TABLE 1

| L | 12 μm | 16.5 μm | 27.5 μm |
|---|---|---|---|
| Ratio of continuation time of solid black in the invention to that in conventional case | 3.0 times | 2.3 times | 2.2 times |

The continuation time in the ink jet print head in this embodiment is twice or more in any case in comparison with the conventional case. Further, it is preferable to set the distance L to be shorter.

[Second Embodiment]

Figure 2A:
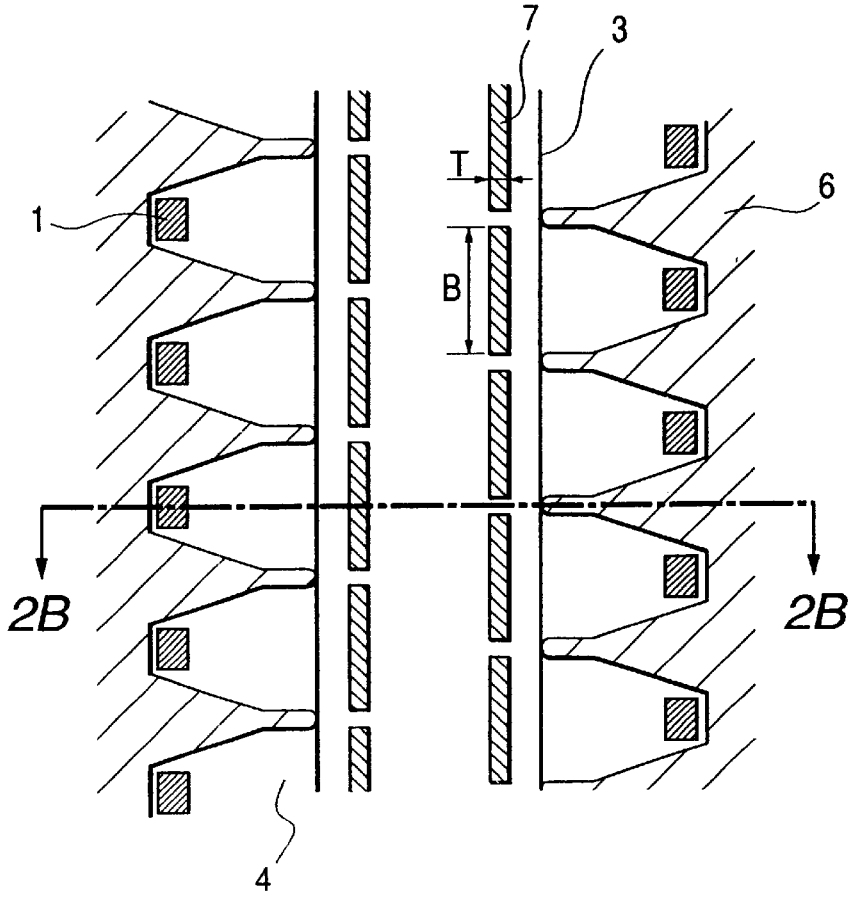
FIG. 2A is a perspective plan view of an ink jet print head in accordance with a second embodiment of the present invention.

FIG. 2A is a typical view of an ink jet print head in accordance with a second embodiment of the present invention. A discharging port is directed downward in FIG. 2B.

Figure 2B:
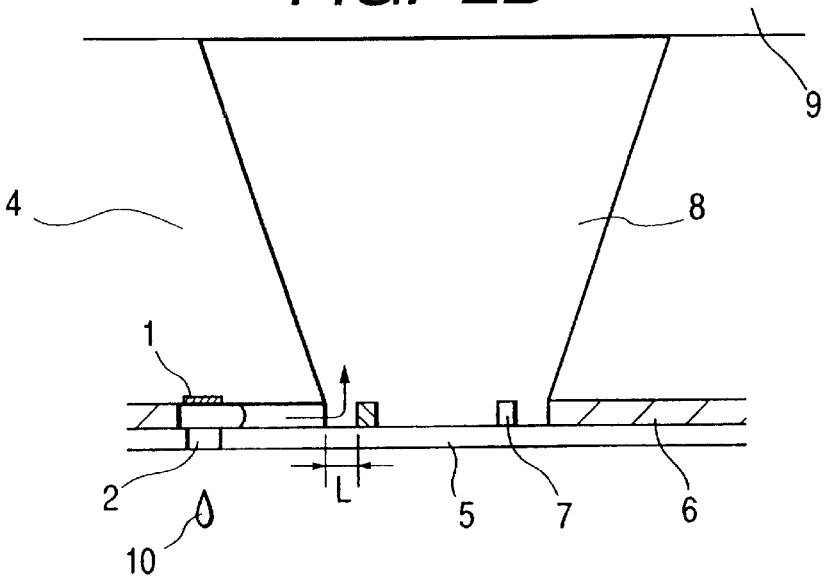
FIG. 2B is a cross-sectional view taken along line 2B—2B of FIG. 2A.

The ink jet print head in this embodiment differs from that in the first embodiment only in the shape of a projection 7 in FIGS. 2A and 2B. The projection 7 has a length of 70 μm in a longitudinal direction B and a thickness T of 15 μm. One projection 7 is arranged with respect to each ink flowing path. The distance L between an ink supplying port end 3 and a wall coming in contact with an ink flow at a discharging time is set to 27.5 μm. A longitudinal length of the ink flowing path is set to be equal to or greater than a width of the ink flowing path such that a direction of the ink flow generated at the discharging time can be effectively changed.

Thus, effects similar to those in the first embodiment can be obtained even when the shape of the projection 7 is different from that in the first embodiment.

[Third Embodiment]

Figure 3A:
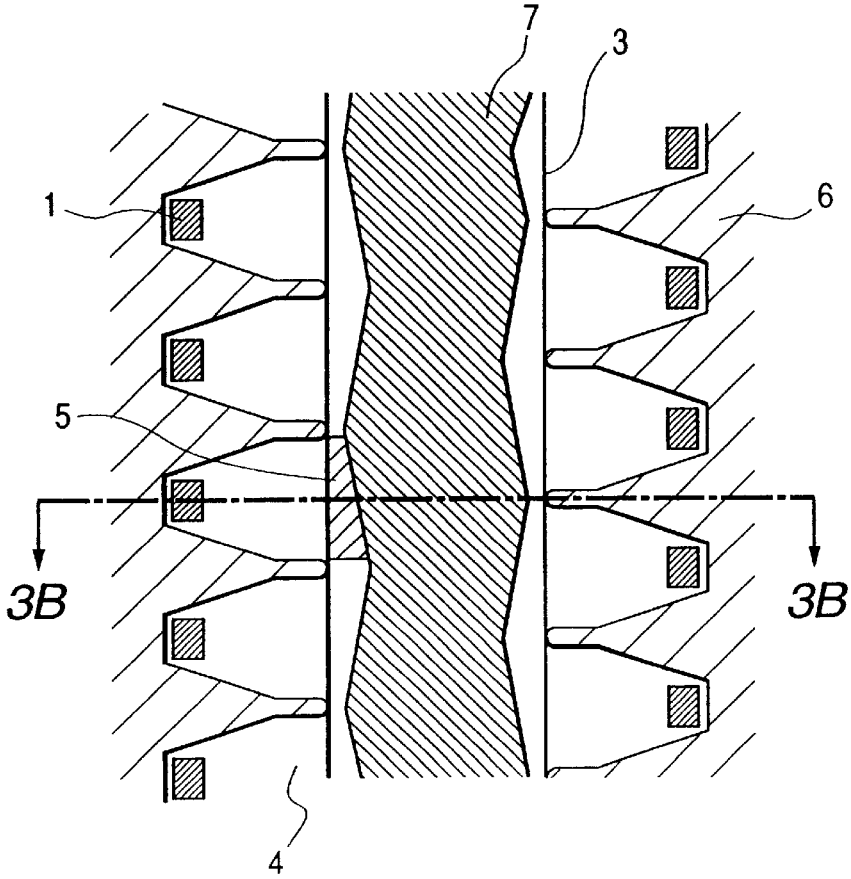
FIG. 3A is a perspective plan view of an ink jet print head in accordance with a third embodiment of the present invention.
Figure 3B:
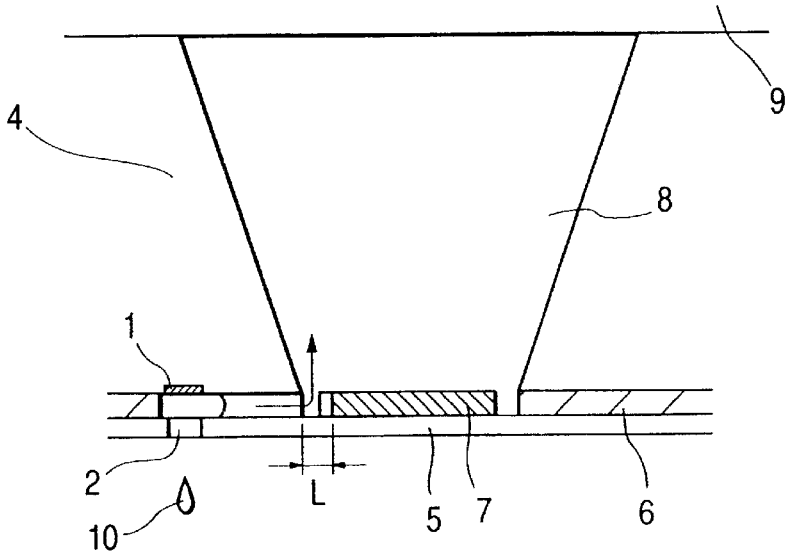
FIG. 3B is a cross-sectional view taken along line 3B—3B of FIG. 3A.

FIG. 3A is a typical view of an ink jet print head in accordance with a third embodiment of the present invention. In FIG. 3B, a discharging port is directed downward.

The ink jet print head in this embodiment differs from that in the first embodiment only in the shape of a projection 7 in FIGS. 3A and 3B. The projection 7 is entirely parallel to a ridgeline of an ink supplying port end 3, but is not parallel to the ridgeline in each ink flowing path unit. For example, a shift in parallel with the ridgeline is 20 μm in a near portion and 35 μm in a far portion. Thus, a clearance required to supply ink can be secured even when the ridgeline of the ink supplying port end 3 is not a straight line, but is locally vibrated. Here, it is preferable that the area S of a portion shown by an oblique line is larger than the cross section of an ink flowing path.

Thus, effects similar to those in the first embodiment can be obtained even when the shape of the projection 7 is different from that in the first embodiment.

[Fourth Embodiment]

Figure 4A:
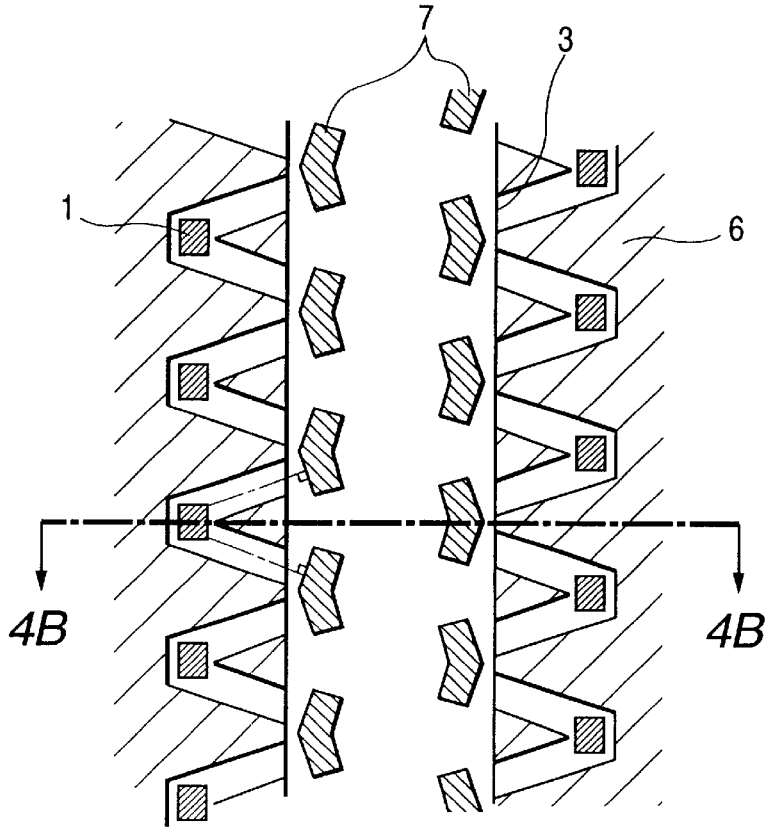
FIG. 4A is a perspective plan view of an ink jet print head in accordance with a fourth embodiment of the present invention.
Figure 4B:
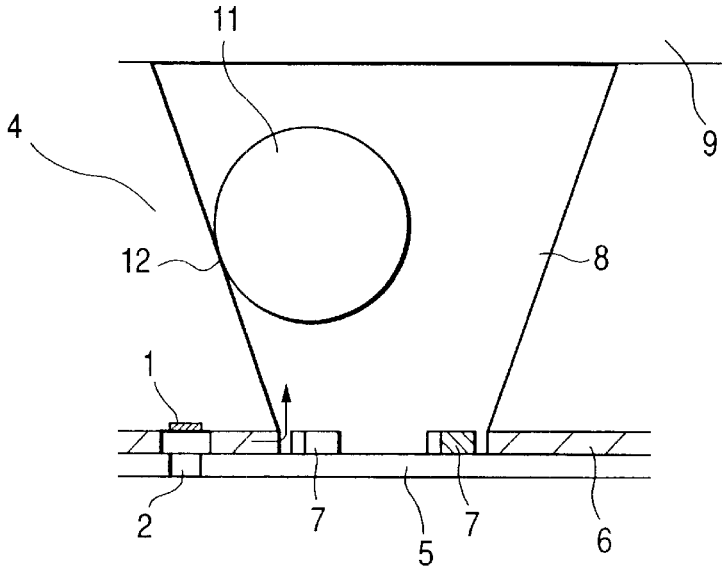
FIG. 4B is a cross-sectional view taken along line 4B—4B of FIG. 4A.

FIG. 4A is a typical view of an ink jet print head in accordance with a fourth embodiment of the present invention. In FIG. 4B, a discharging port is directed downward.

In the ink jet print head in this embodiment, the shape of an ink flowing path differs from that in the first embodiment in that two ink flowing paths are arranged with respect to one discharging port. An outlet of each ink flowing path onto an ink supplying port side has an angle with respect to an ink supplying port. Further, the shape of the projection 7 differs from that in the first embodiment in FIGS. 4A and 4B. As shown in FIGS. 4A and 4B, the projection 7 is perpendicular to a central axis of the ink flowing path. Since the projection 7 is perpendicular to the central axis of the ink flowing path, an ink flow generated from an electrothermal converting element to the ink supplying port side at a discharging time is received from a front face so that the ink flow can be efficiently directed and guided to a wall face side of the ink supplying port.

Thus, effects similar to those in the first embodiment can be obtained even when the shape of the projection 7 is different from that in the first embodiment.

[Fifth Embodiment]

In this embodiment, the surface of a projecting portion is set to have a lyophilic ink property so as to further preferably prevent the attachment of a bubble in a state in which the surface of the projection portion includes the surface of a discharging port plate (an ink supplying port projecting area of the discharging port plate) on an ink flowing path side just above the ink supplying port. Since this portion is set to have the lyophilic ink property, it is greatly reduced that the bubble is attached to the discharging port plate and an end tip of the projection. If the bubble is attached, the bubble is separated from an end tip portion of the projection and stays in the ink supplying port of the ink jet print head or is again dissolved into ink in an intermediate growing process of the bubble in which no bubble yet has an influence on ink droplet discharge. Namely, in the construction in this embodiment, no residual bubble is easily attached to the discharging port plate and the projecting portion in comparison with the conventional case. Further, even if the residual bubble is grown, the residual bubble is sucked into an ink flowing path so that no ink within the ink flowing path is divided into pieces. Accordingly, this construction does not easily cause a phenomenon in which the supply of the ink to the ink flowing path becomes insufficient and the ink within the ink jet print head becomes empty by communication with the atmosphere.

Figure 8A:
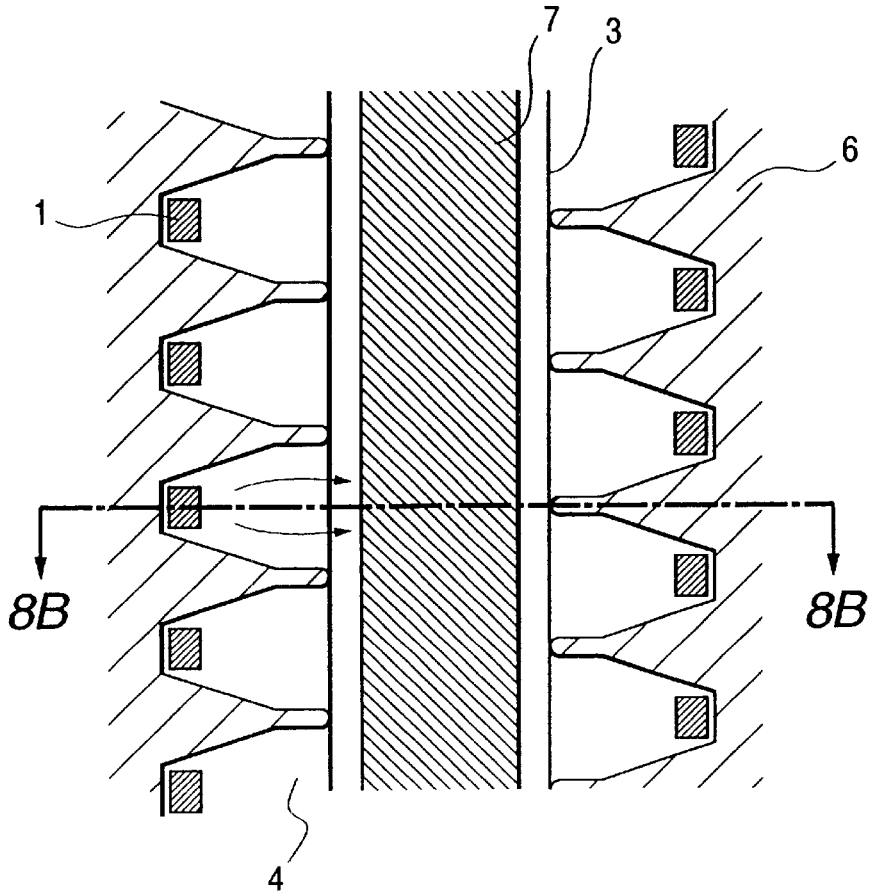
FIG. 8A is a perspective plan view of an ink jet print head in accordance with a fifth embodiment of the present invention.
Figure 8B:
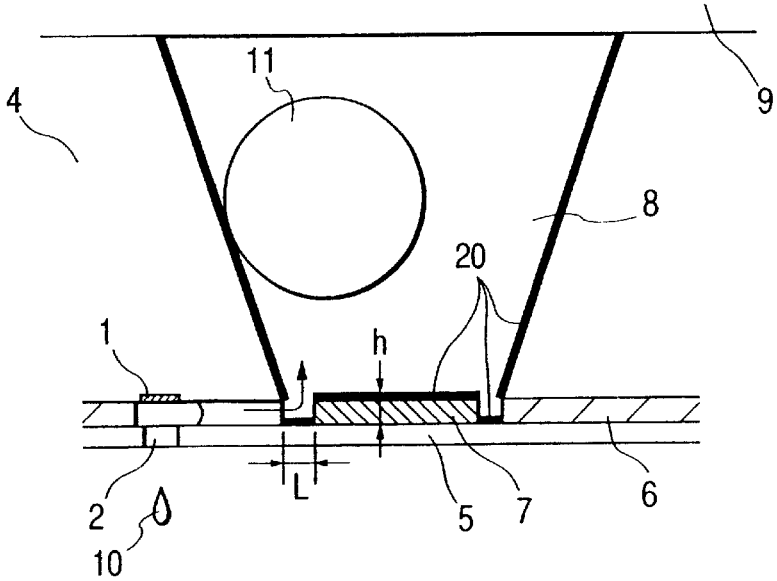
FIG. 8B is a cross-sectional view taken along line 8B—8B of FIG. 8A.

In the ink jet print head in this embodiment, for example, an inner surface of the discharging port plate 5 and the projecting portion 7 can be formed by lyophilic ink processing through the supplying port 3 from a rear face of the substrate 4 in the first embodiment. Concretely, as shown in FIGS. 8A and 8B, a lyophilic ink coating 20 can be formed on the inner surface of the discharging port plate 5 including the projection 7 by using a suitable means such as oxidizing processing of the inner surface of the discharging port plate 5 including the projection 7 using an ozone gas, or sputtering of an inorganic oxide ($SiO_2$, $Al_2O_3$, etc.) having the lyophilic ink property, etc.

Since the lyophilic ink coating 20 is thus formed on the inner surface of the discharging port plate 5 including the projection 7, it is possible to obtain further excellent effects of the bubble attachment prevention in comparison with the first embodiment. In this embodiment, the lyophilic ink coating is applied to the construction of the first embodiment as an example. However, this embodiment is not limited to this case. This embodiment also includes that the lyophilic ink coating is applied to the ink jet print head having another projecting shape.

[Other Embodiments]

Figure 5:
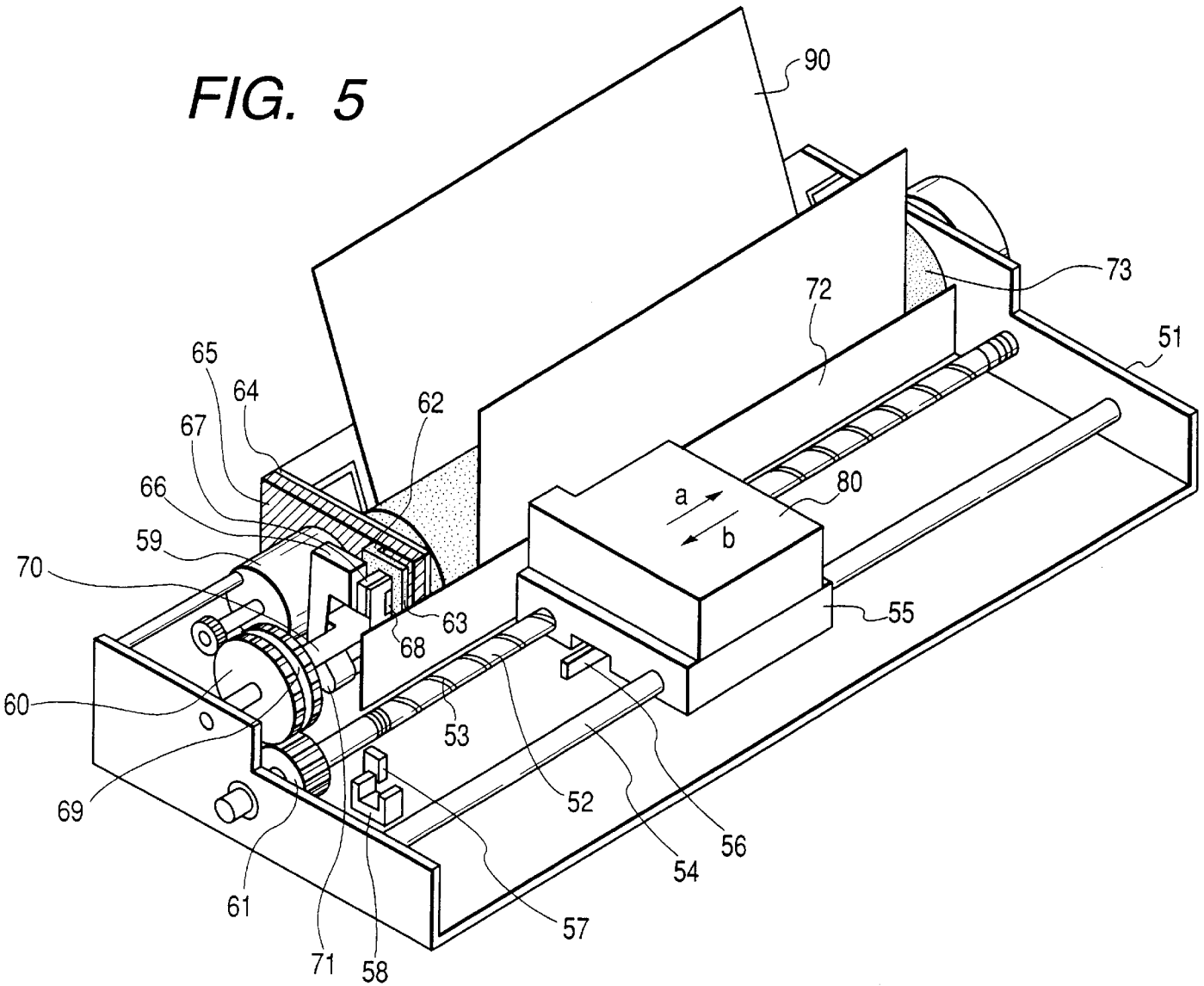
FIG. 5 is an appearance perspective view showing one example of an ink jet printing device to which the ink jet print head applying the present invention thereto is mounted as an ink jet cartridge.

FIG. 5 is a schematic perspective view of an ink jet printing device to which the ink jet print head of the present invention can be mounted.

In FIG. 5, a lead screw 52 having a spiral groove 53 is rotatably pivoted in a body frame 51. The lead screw 52 is moved in association with normal and reverse rotations of a drive motor 59 and is rotated through driving force transmission gears 60, 61. Further, a guide rail 54 for slidably guiding a carriage 55 is fixed to the body frame 51. An unillustrated pin engaged with the spiral groove 53 is arranged in the carriage 55. The carriage 55 can be reciprocated in the directions of arrows a and b in FIG. 5 by rotating the lead screw 52 by rotation of the drive motor 59. A paper pressing plate 72 presses a recording medium 90 against a platen roller 73 in a moving direction of the carriage 55.

An ink jet print head cartridge 80 is mounted to the carriage 55. The ink jet print head cartridge 80 is constructed by integrating one of the ink jet print heads described in the above first to fifth embodiments with an ink tank. This ink jet print head cartridge 80 is fixedly supported by the carriage 55 through a positioning means and electric contacts arranged in the carriage 55, and is detachably attached to the carriage 55.

Photocouplers 57, 58 constitute a home position detecting means for confirming the existence of a lever 56 of the carriage 55 in this area and reversely rotating the drive motor 59, etc. A cap member 67 for capping a front face (an opening face of a discharging port) of the ink jet print head is supported by a supporting member 62. Further, a sucking means 66 is arranged to perform a sucking restoring operation of the ink jet print head through an opening 68 within the cap. A supporting plate 65 is attached to a body supporting plate 64. A cleaning blade 63 slidably supported by this supporting plate 65 is moved in forward and backward directions by an unillustrated driving means. No shape of the cleaning blade 63 is limited to the illustrated one, but a well-known shape can be applied. A lever 70 is arranged to start the sucking restoring operation of the ink jet print head. The lever 70 is moved in accordance with the movement of a cam 71 coming in contact with the carriage 55, and driving force from the driving motor 59 is controlled by well-known transmission means such as a gear, latch switching, etc.

These capping, cleaning and sucking restoring processings are performed in respective corresponding positions by an operation of the lead screw 52 when the carriage 55 is moved to a home position side area. If desirable operations are performed in well-known timing, each of these operations can be applied to this embodiment.

The ink jet printing device explained above has a recording signal supplying means for giving a recording signal for operating an electrothermal converting body of the mounted ink jet print head to the ink jet print head. The ink jet printing device also has a control section for controlling an operation of this ink jet printing device.

Since one of the ink jet print heads described in the above first to fifth embodiments is mounted to the ink jet printing device in this embodiment, a discharging direction of ink is stabilized. As a result, a shift in attaching position of an ink droplet to a recording medium is reduced so that an image having a high quality, etc. can be recorded. In this embodiment, the ink jet print head cartridge 80 is detachably mounted to the carriage 55 as an example. However, this embodiment is not limited to this case. For example, only an ink tank may be detachably mounted by integrating the ink jet print head with the carriage 55.

As explained above, in accordance with the present invention, the bad influence of a bubble left within the ink jet print head on ink droplet discharge is relaxed. Accordingly, it is possible to provide an ink jet print head in which the ink droplet is stably discharged with high reliability. Further, since it is not necessary to often perform restoring processing, throughput is improved and an ink consuming amount is reduced.

What is claimed is:

1. An ink jet print head comprising:

plural electrothermal converting elements for generating energy to produce a bubble used to discharge an ink droplet;

plural ink discharge ports arranged above the electrothermal converting elements and discharging the ink droplet;

plural ink flowing paths respectively communicating with the plural ink discharge ports and internally including said electrothermal converting elements;

a substrate on which are arranged said plural electrothermal converting elements in a columnar shape, said substrate having an ink supplying port constructed by a through port which communicates with said ink flowing paths and extends along an arranging direction of said electrothermal converting elements, said through port having a diameter enlarging from an electrothermal converting element formation surface toward a back surface of said substrate;

a discharging port plate having said ink discharge ports formed therein; and a wall projecting from said discharge port plate and associated with at least one of said ink flowing paths, said wall being positioned to allow a backflow of ink from each said associated ink flowing path upon production of the bubble by a respective electrothermal converting element and configured to direct the backflow toward surfaces of said ink supplying port to prevent attachment of bubbles within the ink supplying port, wherein said ink jet print head is constructed such that said ink flowing paths are formed between said substrate and said discharging port plate by a junction of said discharging port plate with said substrate.

2. The ink jet print head according to claim 1, wherein said wall is constructed by one or plural projections of a rib shape having a surface facing each said associated ink flowing path and extending in the arranging direction of said electrothermal converting elements.

3. The ink jet print head according to claim 2, wherein a length of said surface in the arranging direction of said electrothermal converting elements is approximately equal to or greater than a width of each said associated ink flowing path.

4. The ink jet print head according to any one of claim 2 or 3, wherein a distance between said wall and an edge of said through port is approximately equal to or greater than a height of each of said ink flowing paths.

5. The ink jet print head according to any one of claim 2 or 3, wherein an area including an edge of said through port and perpendicular to a wall face of said ink supplying port and prescribed by a width of a corresponding ink flowing path is equal to or greater than a cross section of said ink flowing path.

6. The ink jet print head according to claim 1 or 2, wherein said substrate is constructed by silicon and said ink supplying port is formed by anisotropic etching of silicon.

7. The ink jet print head according to claim 1 to 2, wherein a surface of said wall is approximately perpendicular to a central axis of said ink flowing paths.

8. The ink jet print head according to claim 1, wherein a surface of a portion of said discharging port plate that projects into said ink supplying port and said wall are coated with a lyophilic ink coating.

9. The ink jet print head according to claim 8, wherein a surface of said ink supplying port is coated with said lyophilic ink coating.

10. An ink jet printing device comprising:

the ink jet print head according to any one of claims 1–3, 8 or 9; and a recording signal supply unit adapted to provide to said ink jet print head a recording signal for operating said electrothermal converting elements of said ink jet print head.

11. An ink jet print head comprising:

plural electrothermal converting elements for generating energy to produce a bubble used to discharge an ink droplet;

plural ink discharge ports arranged above said electrothermal converting elements for discharging the ink droplet;

plural ink flowing paths respectively communicating with said plural ink discharge ports and internally including said electrothermal converting elements;

a substrate on which are arranged said plural electrothermal converting elements in a columnar shape, said substrate having an ink supplying port constructed by a through port which communicates with said ink flowing paths and extends along an arranging direction of said electrothermal converting elements, said through port having a diameter enlarging from an electrothermal converting element formation surface toward a back surface of said substrate;

a discharging port plate having said ink discharge ports formed therein; and a wall projecting from said discharging port plate and associated with at least one of said ink flowing paths, said wall being positioned to allow a backflow of ink from each said associated ink flowing path upon production of the bubble by a respective electrothermal converting element and configured to direct the backflow toward surfaces of said ink supplying port to remove bubbles from said ink supplying port;

wherein said ink jet print head is constructed such that said ink flowing paths are formed between said substrate and said discharging port plate by a junction of said discharing port plate with said substrate.

12. The ink jet print head according to claim 11, wherein said wall is constructed by one or plural projections of a rib shape having a surface facing each said associated ink flowing path and extending in the arranging direction of said electrothermal converting elements.

13. The ink jet print head according to claim 12, wherein a length of said surface in the arranging direction of said electrothermal converting elements is approximately equal to or greater than a width of each said associated ink flowing path.

14. The ink jet print head according to any one of claim 12 or 13, wherein a distance between said wall and an edge of said through port is approximately equal to or greater than a height of each of said ink flowing paths.

15. The ink jet print head according to any one of claim 12 or 13, wherein an area including an edge of said through port and perpendicular to a wall face of said ink supplying port and prescribed by a width of a corresponding ink flowing path is equal to or greater than a cross section of said ink flowing path.

16. The ink jet print head according to claim 11 or 12, wherein said substrate is constructed by silicon and said ink supplying port is formed by anisotropic etching of silicon.

17. The ink jet print head according to claim 11 or 12, wherein a surface of said wall is approximately perpendicular to a central axis of said ink flowing paths.

18. The ink jet print head according to claim 11, wherein a surface of a portion of said discharging port plate that projects into said ink supplying port and said wall are coated with a lyophilic ink coating.

19. The ink jet print head according to claim 18, wherein a surface of said ink supplying port is coated with said lyophilic ink coating.

20. An ink jet printing device comprising:

the ink jet print head according to any one of claim 11–13, 18 or 19; and a recording signal supply unit adapted to provide to said ink jet print head a recording signal for operating said electrothermal converting elements of said ink jet print head.

* * * * *

UNITED STATES PATENT AND TRADEMARK OFFICE

CERTIFICATE OF CORRECTION

PATENT NO. : 6,540,335 B2
DATED : April 1, 2003
INVENTOR(S) : Yoshiyuki Touge et al.

It is certified that error appears in the above-identified patent and that said Letters Patent is hereby corrected as shown below:

Column 10,
Line 27, “the” should read -- said --; and
Line 28, “and” should read -- for --.

Column 11,
Lines 1 and 5, “claim” should read -- claims --.

Column 12,
Line 6, “port;” should read -- port, --; and
Lines 22, 26 and 47, “claim” should read -- claims --.

Signed and Sealed this

Twenty-eighth Day of October, 2003

JAMES E. ROGAN
*Director of the United States Patent and Trademark Office*